US005755307A

United States Patent [19]

Dunnewin et al.

[11] Patent Number: 5,755,307

[45] Date of Patent: May 26, 1998

[54] HYDRAULIC EARTH LEVELING MACHINE

[76] Inventors: Michael A. Dunnewin, P.O. Box 1355, Oakhurst, Calif. 93644; Richard E. Franzke, P.O. Box 1139, North Fork, Calif. 93643

[21] Appl. No.: 845,601

[22] Filed: Apr. 25, 1997

[51] Int. Cl.[6] ..... E06C 7/44

[52] U.S. Cl. ..... 182/202; 248/188.3

[58] Field of Search ..... 182/200–205; 248/188.3

[56] References Cited

U.S. PATENT DOCUMENTS

| | | | |
|---|---|---|---|
| 2,552,941 | 5/1951 | Courtney | 182/202 |
| 2,598,875 | 6/1952 | Anderson | 182/202 |
| 4,095,671 | 6/1978 | Forristall | 182/202 |
| 5,044,468 | 9/1991 | Worthington | 182/202 |

FOREIGN PATENT DOCUMENTS

| | | | |
|---|---|---|---|
| 14367 | 7/1952 | Australia | 182/202 |

*Primary Examiner*—Alvin C. Chin-Shue

*Attorney, Agent, or Firm*—James B. Middleton

[57] ABSTRACT

A hydraulic earth leveling machine has a pair of legs, and cross pieces to connect the legs together. The hydraulic earth leveling machine is attached to a ladder by clamps on the cross pieces. The legs of the hydraulic earth leveling machine telescope; and, as long as there is the weight of the ladder only, the legs freely telescope so the ladder can be set vertically regardless of the slope or obstacles of the terrain. Fluid cylinders within the legs move freely with only the weight of the ladder, the fluid flowing back and forth between the two cylinders to allow motion of the two legs. When additional weight is added to the weight of the ladder, fluid pressure causes control valves to close and prevent fluid flow from either fluid cylinder, so the hydraulic earth leveling machine is locked and stable. The legs have feet that grip the ground to assist in stabilizing the ladder.

4 Claims, 1 Drawing Sheet

HYDRAULIC EARTH LEVELING MACHINE

BACKGROUND OF THE INVENTION

1. Field of the Invention

This invention relates generally to earth leveling machines and the like, and is more particularly concerned with a hydraulic earth leveling machine for attachment to the lower end of a ladder.

2. Discussion of the Prior Art

It has long been recognized that the conventional ladder is hazardous in use because of the tendency of the ladder to slip. First, of course, the ladder needs to be on a horizontal footing so the ladder will extend vertically. Otherwise, the ladder is very likely to fall sideways. Second, the footing of the ladder needs to be held down, or the bottom of the ladder will move out from the support surface so the person on the ladder will fall straight down. Finally, there is the hazard of not having both rails firmly supported. If the two rails are unevenly supported at the top or bottom, the ladder is likely to twist, which may cause a person on the ladder to fall, and may result in the ladder's falling.

There has been considerable effort to support the foot of the ladder, the prior art including a number of adjustable legs or the like so the two rails of the ladder can both be on solid ground. While some of the prior art legs are usable, they require individual adjustment for each placement of the ladder, so they are a good bit of trouble to use. Similarly, the prior art includes rubber feet and the like to prevent sliding of the foot of the ladder. The problems with the top of the ladder have been dealt with by providing connecting members that span both rails at the top of the ladder, and allow a single support point. None of the prior art can truly secure the top of the ladder before anyone climbs the ladder to make it secure.

Thus, the prior art has not provided, for a conventional ladder, a quick and simple stabilizer that automatically adjusts to the conditions and use of the ladder.

SUMMARY OF THE INVENTION

The present invention provides a hydraulic earth leveling machine that is easily fixable to a ladder. The hydraulic earth leveling machine includes a pair of automatically extensible feet that will engage the ground regardless of the particular contour of the ground. The ladder, when used in conjunction with the hydraulic earth leveling machine, is placed in the position desired, and the extensible feet adjust to conform to the surface on which the hydraulic earth leveling machine is sitting. The feet remain adjustable until a person steps onto the ladder; then, the hydraulic earth leveling machine holds the ladder in the position selected, and prevents slipping.

A ladder fixed to the hydraulic earth leveling machine of the present invention is therefore quite secure, being held vertically to prevent side tipping, having the feet held against slipping, and having the ladder held against twisting. All aspects of the hydraulic earth leveling machine are automatic, so set-up is quick and easy, and the ladder may be used to its fullest capacity by fire fighters and others dealing with emergency situations.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
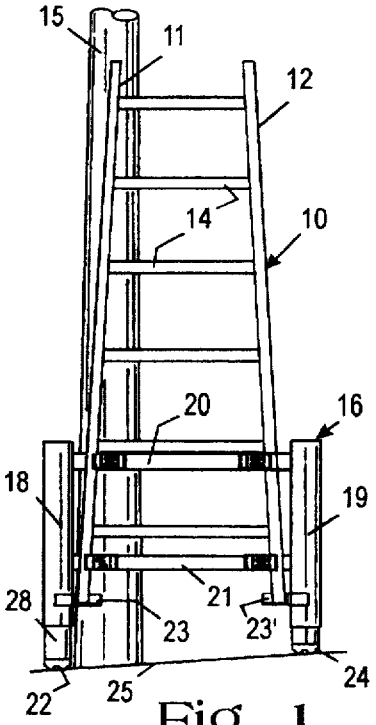
FIG. 1 is a front elevational view of a ladder having one rail against a post, the ladder being mounted in a hydraulic earth leveling machine made in accordance with the present invention.

Referring now more particularly to the drawings, and to that embodiment of the invention here presented by way of illustration, FIG. 1 of the drawings shows a conventional ladder 10 having left and right rails 11 and 12, and a plurality of rungs, or steps, 14 extending between the rails 11 and 12. As here shown, one rail 11 of the ladder 10 is against a support 15, such as a tree, utility pole or the like. While support of only one rail of a ladder 10 is not recommended, the illustration assists in conveying the concept and operation of the device of the present invention.

The lower end of the ladder 10 is held by the hydraulic earth leveling machine of the present invention, generally designated at 16. The hydraulic earth leveling machine 16 includes a pair of parallel legs 18 and 19 with lateral braces 20 and 21 extending therebetween. Fixed to the legs 18 and 19, and extending towards each other, are resting pads 23 and 23' for receiving the lowermost ends of the rails 11 and 12 of the ladder 10.

On each of the lateral braces 20 and 21 there is a pair of ladder clamps which will be discussed in more detail hereinafter. From the above discussion, however, those skilled in the art will understand that the ladder 10 is placed with its feet on the resting pads 23 and 23', and the rails 11 and 12 against the lateral braces 20 and 21. The ladder clamps will then secure the rails to the lateral braces, so the hydraulic earth leveling machine 16 is fixed to the ladder 10.

Each of the legs 18 and 19 of the hydraulic earth leveling machine 16 has a foot 22 and 24. The ground or other supporting surface 25 is here shown as slanted to show that the feet 22 and 24 will readily adjust to hold the ladder 10 vertically, even though the support surface 25 is sloped.

Figure 2:
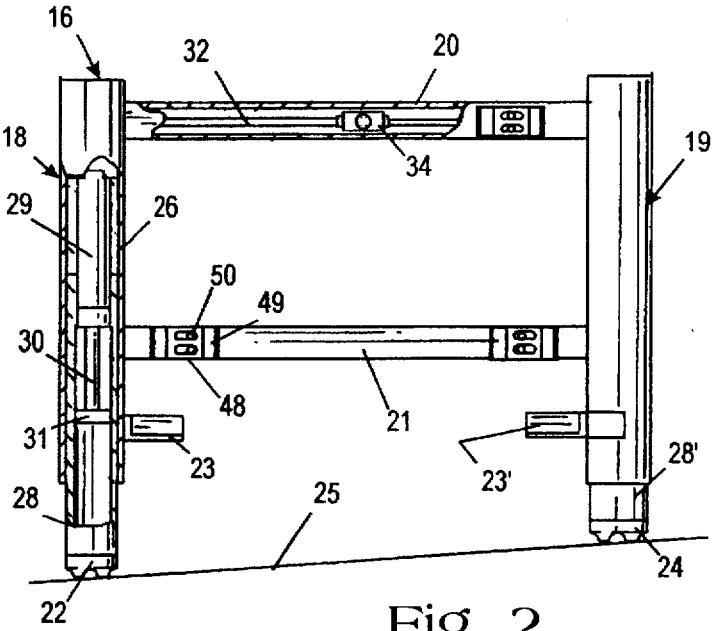
FIG. 2 is an enlarged front elevational view of the hydraulic earth leveling machine shown in FIG. 1, with the ladder omitted, and portions of the hydraulic earth leveling machine being shown in cross-section to illustrate the construction.

For a better understanding of the construction of the hydraulic earth leveling machine of the present invention attention is directed to FIG. 2 of the drawings. The left leg 18 is shown mostly in cross-section to show the internal construction, and it should be understood that the right leg 19 is constructed the same, but as a mirror image. Thus, the leg 18 comprises an upper leg portion 26 which telescopingly receives a lower leg portion 28. The foot 22 is carried at the lower end of the lower leg portion 28.

Within the upper leg portion 26 there is a fluid cylinder 29. The rear, or upper, end of the cylinder 29 is fixed with respect to the upper leg portion 26, while the piston rod 30 is fixed with respect to the lower leg portion 28, as at 31.

The upper lateral support 20 houses a fluid line 32 having a bleed valve 34 therein. As will be understood later, the cylinder 29 is connected through a control valve to the fluid line 32, through the bleed valve 34, and to the cylinder in the right leg 19. As a result, it will be seen that, when the lower leg portion 28 is moved up to retract the piston rod 30, fluid will flow through the control valve, through the line 32 and the valve 34, and to the cylinder in the leg 19. Thus, as one lower leg portion 28 is retracted, the other lower leg portion 28' will be projected, and vice versa. However, if the control valve does not allow fluid flow, motion of both lower leg portions is precluded.

Figure 3:
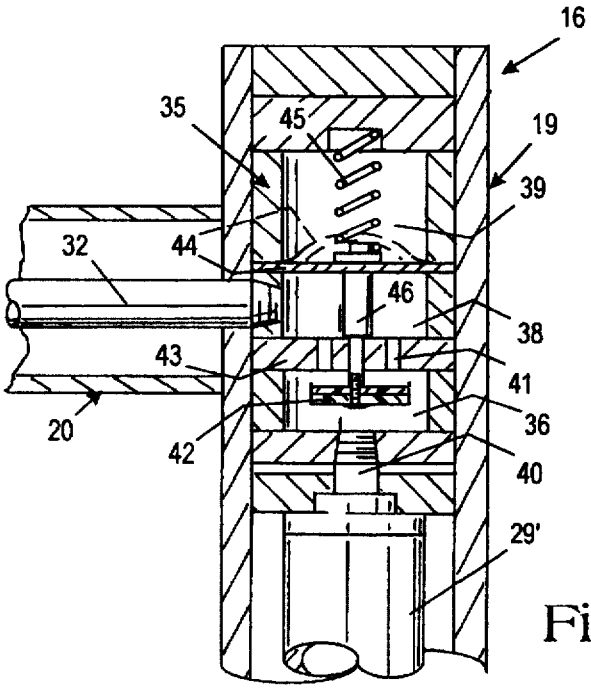
FIG. 3 is an enlarged cross-sectional view showing a control valve used in the hydraulic earth leveling machine of FIGS. 1 and 2; and, FIG. 4 is an enlarged perspective view showing one of the feet of the hydraulic earth leveling machine of the present invention.

FIG. 3 of the drawings shows a control valve for use in the apparatus of the present invention. Again, it will be understood that a similar valve is in the leg 18, constructed as the mirror image of the one shown. The control valve is generally designated at 35, and includes a lower fluid chamber 36 and an upper fluid chamber 38. Above the upper fluid chamber 38 there is a spring chamber 39.

The lower fluid chamber 36 is in communication with the cylinder 29' through the nipple 40. The lower chamber 36 is also in communication with the upper fluid chamber 38 through passages 41 in a wall 43 so long as the valve member 42 is in its lower position as shown in the drawings. It will be seen, however, that when the valve member 42 moves up, it will close the passages 41 to prevent fluid flow therethrough.

So long as fluid can flow through the passages 41, it will be seen that fluid can flow from the cylinder 29', through the fluid chambers 36 and 38, and to the fluid line 32. Fluid can then flow from the fluid line 32, through the control valve in the left leg 18, and into the cylinder 29.

Between the upper fluid chamber 38 and the spring chamber 39, there is a flexible diaphragm 44. A spring 45 exerts force between the diaphragm 44 and the upper wall of the chamber 39. A valve stem 46 extends from the diaphragm 44, through the wall 43 between the upper and lower fluid chambers 36 and 38, and carries the valve member 42. As a result, when the pressure within the chamber 38 increases sufficiently, the diaphragm 44 will be distorted upwardly as shown in broken lines, the valve stem 46 will move up, and the valve member 42 will be pulled up to close the passages 41.

As was mentioned briefly above, there are ladder clamps on the lateral braces 20 and 21. Those skilled in the art will devise numerous forms of clamping means, but the ladder clamps here shown are adequate, and are simple and quick to use. Each of the clamps includes a central body 48 having outwardly extending flanges 49 at each end thereof. Elongated holes in the body 48 receive screws 50 for selectively fixing the clamps in place. Thus, with a ladder in position as shown in FIG. 1, the ladder clamps will be slid over so that an outwardly extending flange 49 engages a rail of the ladder. The screws 50 will then be tightened to hold the clamp in place.

Figure 4:
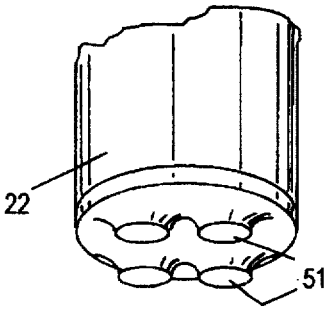

FIG. 4 of the drawings is a perspective view showing one form of foot for use in the present invention. Since the hydraulic earth leveling machine of the present invention is to hold a ladder, the hydraulic earth leveling machine itself must have a stable footing. To this end, the feet 22 and 24 include a plurality of contact areas 51 with valleys therebetween. Since the contact area of the foot 22 is reduced, the force per unit area will be increased for better gripping of the foot 22. Also, the valleys provide channels for escape of mud or the like so the foot 22 can settle onto a firm foundation.

With the above and forgoing description in mind, it will be understood by those skilled in the art that a hydraulic earth leveling machine 16 will be attached to a ladder 10 using the plurality of ladder clamps. The ladder and hydraulic earth leveling machine can then be set up, as for example leaning against a post 15. When the ladder 18 is first placed upright, the spring 45 will be urging the diaphragm 44 down, to open the passages 41 so fluid can flow freely from the cylinder 29 to the cylinder 29' and back, so the lower leg portions 28 and 28' can be moved in and out until the ladder 10 is standing vertically regardless of the slope or obstacle of the supporting surface 25.

Once the ladder 10 is properly placed, a person can mount the ladder 10, stepping on a rung 14. The weight of the person will urge the stabilizer 16 down, expelling fluid from the cylinders 29 and 29'. Since the fluid cannot flow, due to balanced forces, the pressure within the chamber 38 will be increased, causing the diaphragm 44 to distort and closing the passages 41. The cylinder 29' is then isolated, and there can be no further fluid flow from the cylinder. This condition will remain so long as the weight of the person is on the ladder.

When the person leaves the ladder, the pressure within the chamber 38 will be lowered, and the spring 45 will urge the diaphragm 44 down, which will move the valve body 42 to open the passages 41. Fluid can again flow between the two cylinders 29 and 29', so the legs are again adjustable.

In view of the fact that the device of the present invention is intended to be very stable, it is contemplated that the fluid utilized with the device will be a liquid. Nevertheless, there may be some situations in which a gas is acceptable, and both are included within the present inventive concept.

Thus, it will be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

What is claimed as invention is:

1. A hydraulic earth leveling machine, for attachment to a ladder comprising a pair of generally parallel rails and a plurality of rungs extending between said parallel rails, said hydraulic earth leveling machine comprising a pair of parallel legs, each leg of said pair of legs including an upper portion fixed with respect to said ladder, and a lower portion movable axially with respect to said upper portion, means for selectively fixing said lower portions of said legs with respect to said upper portions of said legs, each leg of said pair of legs of said hydraulic earth leveling machine being adjacent to one rail of said pair of rails of said ladder, and further including at least one lateral support extending between said pair of legs of said hydraulic earth leveling machine, said means for selectively fixing said lower portions of said legs with respect to said upper portions of said legs comprising a fluid cylinder in one leg of said hydraulic earth leveling machine, said cylinder being fixed with respect to said upper portion of said one leg, and having a piston rod fixed with respect to the lower portion of said leg, and a control valve for selectively allowing fluid flow to and from said cylinder, a second cylinder in the other leg of said hydraulic earth leveling machine, said second cylinder being fixed with respect to said upper portion of said other leg, and including a piston rod fixed with respect to said lower portion of said other leg, a second control valve for selectively allowing fluid flow to and from said second cylinder, and including a fluid line for connecting said cylinder with said second cylinder so that fluid flowing from one of said cylinders flows to the other of said cylinders, wherein said control valve is within said upper portion of said leg, said leg defining a lower chamber in communication with said cylinder, an upper chamber selectively in communication with said lower chamber, a flexible diaphragm defining the upper side of said upper chamber, and a valve member fixed to said diaphragm for selectively closing passages between said lower chamber and said upper chamber in response to high pressure is said upper and lower chamber.

2. A hydraulic earth leveling machine as claimed in claim 1, and including clamping means carried by said lateral support for fixing said ladder to said hydraulic earth leveling machine.

3. A hydraulic earth leveling machine, for attachment to a ladder comprising a pair of generally parallel rails and a plurality of rungs extending between said parallel rails, said hydraulic earth leveling machine comprising a pair of parallel legs, each leg of said pair of legs including an upper portion fixed with respect to said ladder, and a lower portion movable axially with respect to said upper portion, means for selectively fixing said lower portions of said legs with respect to said upper portions of said legs, each leg of said pair of legs of said hydraulic earth leveling machine being adjacent to one rail of said pair of rail of said ladder, at least one lateral support extending between said pair of legs of said hydraulic earth leveling machine, said means for selectively fixing said lower portions of said legs with respect to said upper portions of said legs comprising a fluid cylinder in one leg of said hydraulic earth leveling machine, said cylinder being fixed with respect to said upper portion of said one leg, and having a piston rod fixed with respect to the lower portion of said leg, a control valve for selectively allowing fluid flow to and from said cylinder, a second cylinder in the other leg of said hydraulic earth leveling machine, said second cylinder being fixed with respect to said upper portion of said other leg, and including a piston rod fixed with respect to said lower portion of said other leg, a second control valve for selectively allowing fluid flow to and from said second cylinder, a fluid line for connecting said cylinder with said second cylinder so that fluid flowing from one of said cylinders flows to the other of said cylinders said control valve being within said upper portion of said leg, said leg defining a lower chamber in communication with said cylinder, an upper chamber selectively in communication with said lower chamber, a diaphragm defining the upper side of said upper chamber, and a valve member fixed to said diaphragm for selectively closing passages between said lower chamber and said upper chamber, and including spring means for urging said diaphragm down towards said upper chamber, said valve member being carried by said diaphragm for movement therewith so that upward motion of said diaphragm causes said valve member to close said passages between said lower chamber and said upper chamber.

4. A hydraulic earth leveling machine as claimed in claim 3, and including clamping means carried by said lateral support for fixing said ladder to said hydraulic earth leveling machine.

* * * * *